United States Patent [19]

Casey

[11] 4,453,307

[45] * Jun. 12, 1984

[54] TERMINATING TOOL

[75] Inventor: Daniel T. Casey, Harrisburg, Pa.

[73] Assignee: AMP Incorporated, Harrisburg, Pa.

[ * ] Notice: The portion of the term of this patent subsequent to Jun. 28, 2000 has been disclaimed.

[21] Appl. No.: 364,103

[22] Filed: Mar. 31, 1982

[51] Int. Cl.[3] ..... H01R 43/04

[52] U.S. Cl. ..... 29/751; 29/759

[58] Field of Search ..... 29/751, 752, 753, 754, 29/759, 566.3, 566.4

[56] References Cited

U.S. PATENT DOCUMENTS

| | | | |
|---|---|---|---|
| 3,039,337 | 6/1962 | Stuart-Prince | 81/15 |
| 3,742,571 | 7/1973 | Brehm | 29/751 |
| 4,243,288 | 1/1981 | Lucius et al. | 339/99 R |
| 4,286,381 | 9/1981 | Litehizer, Jr. | 29/751 |
| 4,389,769 | 6/1983 | Casey | 29/751 |

*Primary Examiner*—Carl E. Hall

*Attorney, Agent, or Firm*—Russell J. Egan

[57] ABSTRACT

A hand tool for inserting wires into electrical terminals of an electrical connector has a wire insertion head defining a channel for the connector and a ram for driving wires successively into terminals of the connector. The connector is advanced in a step wise fashion through the channel after each wire has been inserted into a terminal. The ram has a depending pin engaging in a transverse slot in a cam plate carrying a spring loaded connector advancing pawl for engaging openings in the connector.

5 Claims, 4 Drawing Figures

TERMINATING TOOL

The present invention relates to a hand tool of the type utilized to effect termination of individual conductors in an electrical connector carrying a plurality of terminals each having an insulation displacing conductor receiving portion.

The present invention relates to an improvement in the tool described in my co-pending application Ser. No. 06/246,989 filed Mar. 24, 1981, now U.S. Pat. No. 4,389,769, the disclosure of which is incorporated herein by reference. A somewhat similar tool, which also includes a wire trimming feature is also disclosed in U.S. Pat. No. 3,742,571.

The present invention is a hand tool having a work frame upon which is located an indexing means and a wire stuffing means, both actuated by a trigger gripping mechanism. The connector terminated by the subject tool is of the type having a series of partly open passages, each containing a terminal having an insulation displacing portion accessible in an open portion of the respective passage. As the connector is sequenced through the subject tool, the wire is driven into an exposed portion of a respective terminal and a connector indexed to present the next sequential terminal to the wire stuffing means. The subject invention includes positive retention means for the connector assuring only a unidirectional movement through the tool.

The present invention will be described by way of example with reference to the accompanying drawings in which.

Figure 1:
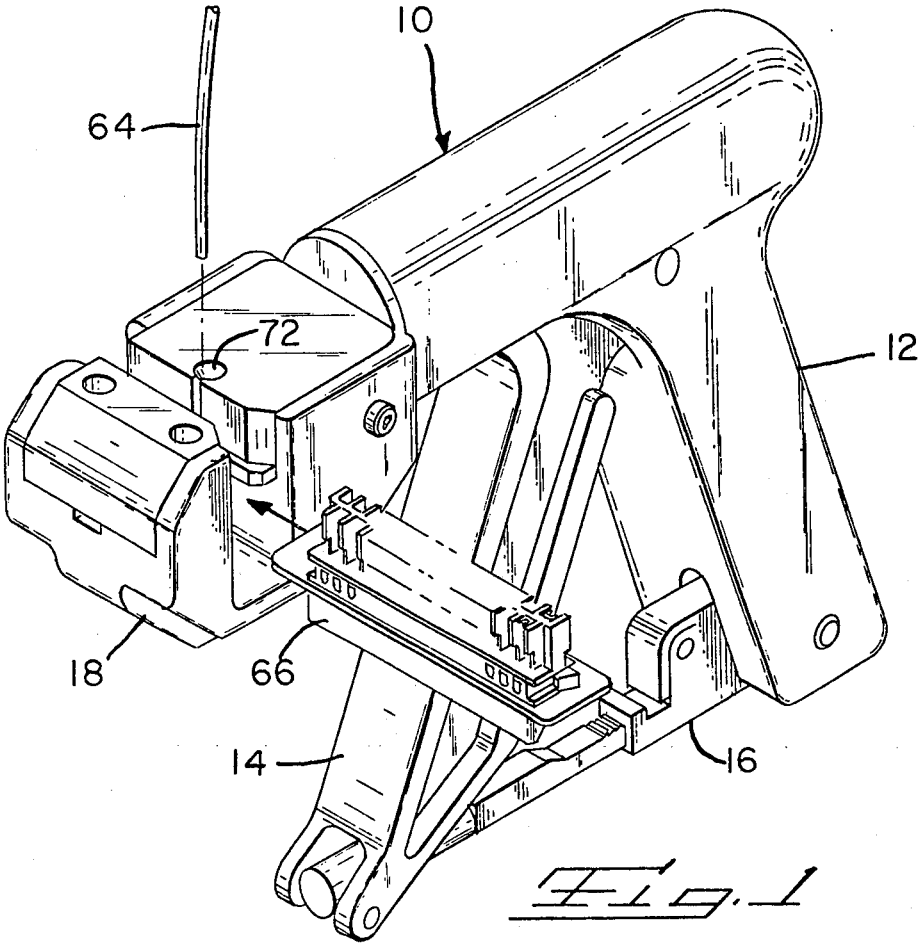
FIG. 1 is a perspective view of the subject tool with a connector and a conductor exploded therefrom.

The subject terminating tool 10 includes a hand grip 12 with an actuating lever 14 and a ratchet mechanism 16 mounted therein. The ratchet mechanism 16 can be of the type disclosed in U.S. Pat. No. 3,039,337, the disclosure of which is incorporated herein by reference. The tool 10 also includes an insertion head 18 which has a cylindrical portion 20 received in a bore 22 of the hand grip 12. The cylindrical portion 20 has an axial bore 24 which receives an actuation rod 26 in known fashion. The rod 26 is spring biased by a compression spring 28 and driven by a lever 14 in the manner disclosed by U.S. Pat. No. 3,742,571, the disclosure of which is incorporated herein by reference.

Figure 2:
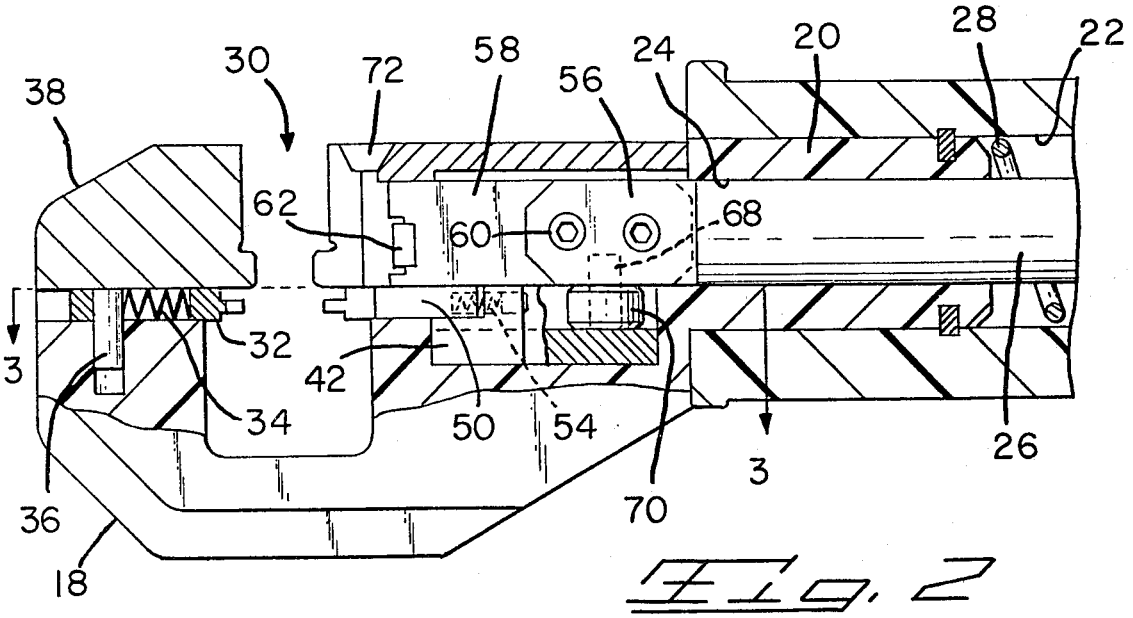
FIG. 2 is a side elevation, partially in section, through the wire stuffing portion of the subject tool.

The insertion head 18 has a transverse connector channel 30, best seen in FIG. 2, which is profiled to receive therein an electrical connector similar to the type disclosed in U.S. Pat. No. 4,243,288, the disclosure of which is incorporated herein by reference. Opening into one side of the channel 30 there is a spring loaded ratchet stop including a pawl 32, a spring 34, a mounting pin 36, and a cover 38 held in the head 18 by bolts 40. On the opposite wall of the channel there is a horizontal slot 42 having therein a profiled plate 44 (seen in FIGS. 3 and 4) having a driving slot 46 therein. The forward part of the plate 44 has a recess 48 containing therein a driving pawl 50 having a connector engaging tooth 52 and being spring loaded by a compression spring 54.

The conductor insertion mechanism has a driving yoke portion 56 formed on the end of the actuation rod 26 and an insertion member 58 mounted therein by bolts 60. The insertion member 58 has a profiled leading end 62 profiled for engaging a wire 64 and drivingly inserting it into a terminal (not shown) of the above mentioned electrical connector 66. The insertion member 58 also has a downwardly directed pin 68 with a bearing 70 on the free end thereof sliding in slot 46 of plate 44.

Figure 3:
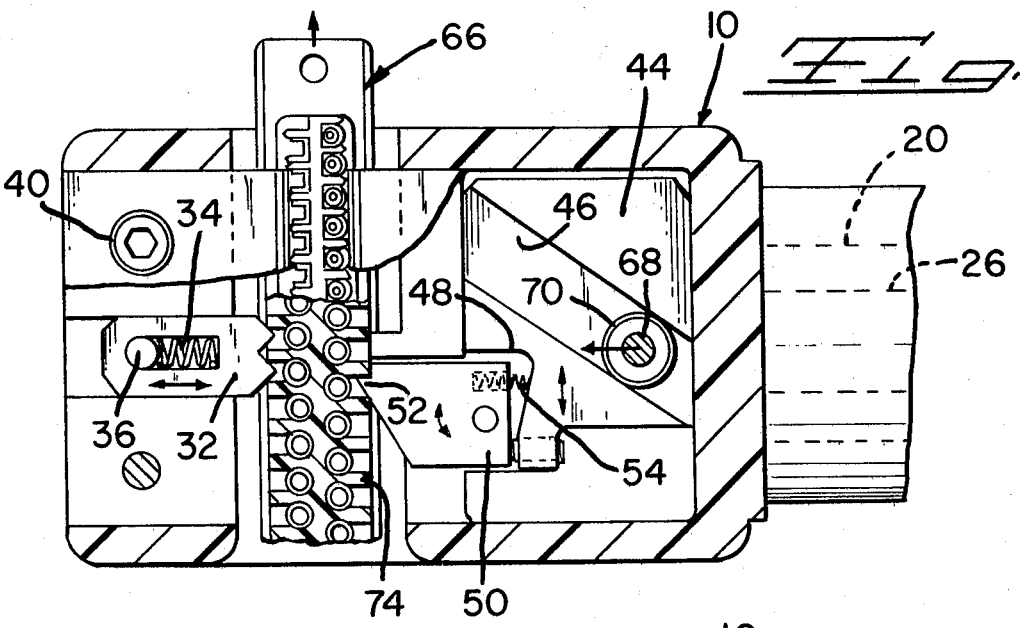
FIG. 3 is an instantaneous section taken along line 3—3 of FIG. 1 with the tool in a first condition prior to a termination cycle.
Figure 4:
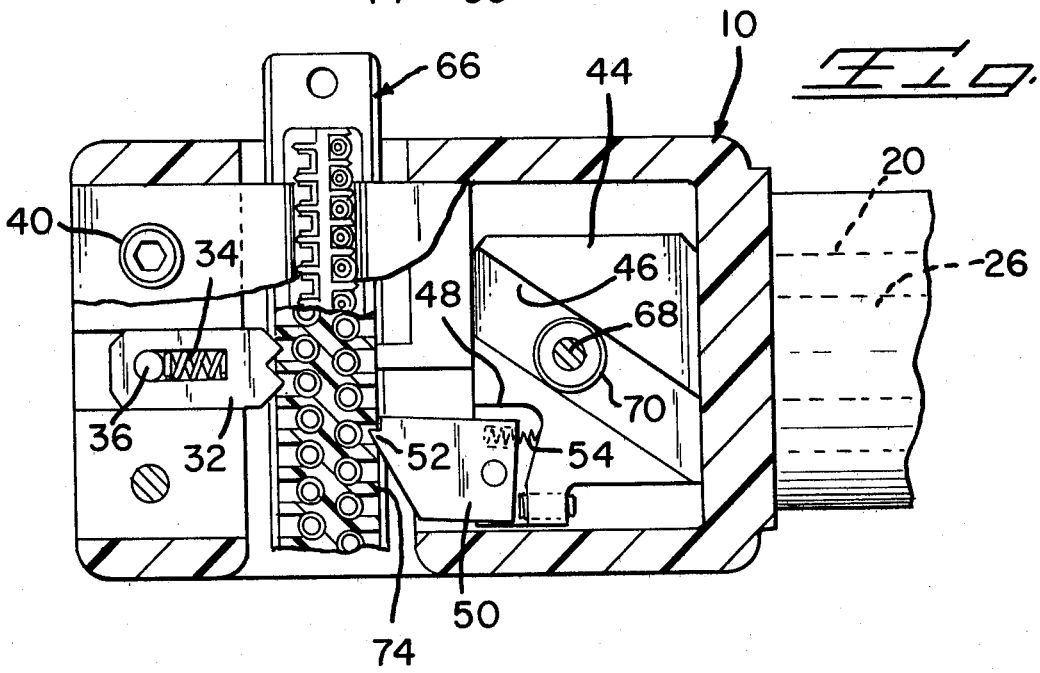
FIG. 4 is an instantaneous section, similar to that of FIG. 3, showing the tool at the end of a termination cycle.

In operation the connector 68 is inserted into the channel 30, as shown in FIG. 1, and the wire 64 is inserted into the vertical slot 72. The actuation mechanism 14 is squeezed against the hand grip 12 driving the actuation rod 26 forward against the restraining action of the spring 28. This will cause the yoke 56 to move forwardly so that the leading end 62 of the insertion member 58 engages the wire 64 and drives it into a waiting terminal (not shown). At the same time, the forward movement of the yoke 56 causes a sideward movement of plate 44 (downward as shown in FIGS. 3 and 4) through the engagement of the bearing 70 in the slot 46. At the end of the forward motion of the yoke portion 56 of the tooth 52 of the pawl 48 slides over an intermediate wall 74 of the connector 66 and engages the next successive slot to drive the connector 66 through the tool (upwards as shown in FIGS. 3 and 4). The pawl 32 secures the connector 66 against a return movement.

The illustrated connector 66 is a double row connector and would have to be sent through the tool twice so as to terminate wires to terminals on each side thereof.

I claim:

1. A hand tool for successively connecting wires to respective electrical terminals arranged in a row extending along at least one side of a housing of an electrical connector, the tool comprising a wire insertion head, defining a connector channel, a wire insertion ram, means for driving the ram towards and away from the channel transversely of the length thereof, and means connected to the ram for advancing the connector step by step through the channel to bring each successive terminal into alignment with the ram to allow the ram to drive a wire into the terminal, wherein the connector advancing means comprises:

a cam plate having a cam slot extending transversely of the path of movement of the ram, a camming pin fixed with respect to the ram and sliding in said cam slot, a connector advancing pawl mounted in a leading edge of said cam plate, and spring means biasing said pawl into engagement with the connector, whereby the cam plate is driven by the ram transversely of the path of movement thereof.

2. A tool according to claim 1, wherein the cam plate is slidably mounted in a recess in the insertion head, the cam slot being remote from the pawl.

3. A tool according to claim 1, wherein the ram is received in a yoke member connected to a ram drive shaft, the camming pin extending from the yoke member.

4. A tool according to claim 3, wherein the ram is received in an axial channel in the yoke member, the camming pin being slidably received in an opening in the bore of the channel.

5. A tool according to claim 1, further comprising: a spring loaded ratchet stop projecting from a sidewall of the channel which is remote from the ram and in substantial alignment with the pawl.

* * * * *